US008462068B2

(12) United States Patent
Kim et al.

(10) Patent No.: US 8,462,068 B2
(45) Date of Patent: Jun. 11, 2013

(54) LOG PERIODIC ANTENNA AND MANUFACTURING METHOD THEREOF

(75) Inventors: Keyng Hun Kim, Tongyeong (KR); Seung Kyo Park, Daejeon (KR); Chan Kuk Kim, Daejeon (KR)

(73) Assignees: Menix Co., Ltd., Daejeon (KR); Kim, Keyng Hun, Tongyeong (KR)

( * ) Notice: Subject to any disclaimer, the term of this patent is extended or adjusted under 35 U.S.C. 154(b) by 398 days.

(21) Appl. No.: 12/954,354

(22) Filed: Nov. 24, 2010

(65) Prior Publication Data

US 2011/0227802 A1 Sep. 22, 2011

(30) Foreign Application Priority Data

Mar. 16, 2010 (KR) ..... 10-2010-0023356

(51) Int. Cl.
*H01Q 9/16* (2006.01)

(52) U.S. Cl.
USPC ..... 343/792

(58) Field of Classification Search
USPC ..... 343/790–792
See application file for complete search history.

(56) References Cited

U.S. PATENT DOCUMENTS

| | | | | |
|---|---|---|---|---|
| 4,313,121 | A * | 1/1982 | Campbell et al. | 343/790 |
| 5,652,598 | A * | 7/1997 | Campbell et al. | 343/791 |
| 6,081,236 | A * | 6/2000 | Aoki | 343/702 |
| 7,164,380 | B2 * | 1/2007 | Saito | 342/42 |
| 8,013,799 | B2 * | 9/2011 | Chung et al. | 343/791 |

* cited by examiner

*Primary Examiner* — Huedung Mancuso

(57) ABSTRACT

Disclosed is a log periodic antenna and a manufacturing method thereof. In the log periodic antenna, antenna elements are attached to an antenna body to thereby simplify a structure of the antenna, the antenna can be manufactured in various designs without restriction to the configuration of the antenna, and the number of contacting points between the antenna element and a feeder is minimized to thereby simplify the manufacturing process. By the antenna, it is possible to produce the log periodic antenna of the simple structure and of various designs without the restriction to the antenna configuration by attaching the signal pattern and ground pattern to the pattern receiving surface.

4 Claims, 6 Drawing Sheets

LOG PERIODIC ANTENNA AND MANUFACTURING METHOD THEREOF

BACKGROUND OF THE INVENTION

1. Field of the Invention

The present invention relates to a log periodic antenna and a manufacturing method thereof, and more particularly to a log periodic antenna and a manufacturing method thereof that make antenna elements attached to an antenna body to thereby simplify a structure of the antenna, that enable the antenna to be manufactured in various designs without restriction to the configuration of the antenna, and that make the number of contacting points between the antenna element and a feeder to be minimized to thereby simplify the manufacturing process.

2. Description of the Prior Art

As generally known in the art, the log periodic antenna is a broadband antenna wherein the length ratio and the interval ratio of adjacent antenna elements are constant and wherein it has almost constant frequency response within the frequency range of the longitudinal-type antenna row.

The log periodic antenna is being widely used for receiving the digital broadcast ever since the latter was full-fledged. In the prior art, the antenna was mostly made of a rod-type element, but nowadays a different antenna with the antenna element printed on a PCB substrate is used.

The antenna made of the rod-type element has the disadvantages in that it is heavy and weak to the external impact because the rod is made from aluminum or stainless steel. However, the log periodic antenna on the PCB substrate has the advantages in that it is strong to the external impact, maintains stable receiving characteristics, and hides the antenna element to thereby improve the outer configuration of the antenna. Accordingly, the log periodic antenna is widely used as an outdoor antenna or an indoor antenna at home.

When manufacturing the above-described log periodic antenna, the steps of: partially etching a surface of a PCB substrate; printing a signal pattern at one side of the etched surface and a ground pattern at the other side of the etched surface; and connecting portions of the printed signal pattern and portions of the printed ground pattern to a feeder of the antenna by soldering without omission are included.

Korea Utility Model No. 0370996 discloses such a conventional log periodic antenna.

FIG. 1 is a bottom view of the conventional log periodic antenna. Referring to the drawing, antenna elements 21 are symmetrically printed at either side on a surface of a plane antenna 20. A feeder 24 extending across the middle of the plane antenna 20 is fixed.

As illustrated in FIG. 1, the antenna elements 21 are printed at either side of the plane antenna 20 wherein the signal pattern is printed at one side and the ground pattern is printed at the other side. The feeder 24 is disposed to extend across the antenna elements 21. Also, the contacting portions between the feeder 24 and the antenna elements 21 are connected by soldering.

In manufacturing the conventional antenna described above, the PCB substrate should be prepared beforehand to fit to the configuration of a main body of the antenna. Further, a pattern printing, which is deemed to be difficult in the field of the art, is needed to prepare the PCB substrate. Accordingly, it is impossible to change the configuration of the main body of the antenna after settling the patterns to be printed on the PCB substrate.

Moreover, the manufacturing process is rather complicated because the soldering should be performed to connect the antenna devices 21 to the feeder 24.

SUMMARY OF THE INVENTION

Accordingly, the present invention has been made to solve the above-mentioned problems occurring in the prior art, and an object of the present invention is to provide a log periodic antenna with antenna elements attached to a main body thereof, so that the antenna has a simple structure and covers various designs without any restriction to the configuration of the antenna.

The other object of the present invention is to provide a manufacturing method of a log periodic antenna, which makes the manufacturing process simple by minimizing the contacting points between the antenna elements and the feeder.

In order to accomplish this object, there is provided a log periodic antenna comprising a pattern receiving surface 110 for receiving a signal pattern 300 and a ground pattern 500, said antenna further comprising: a feeder 200 having core line 230 wrapped by an insulator 220 and a shield line 210 shielding the feeder 200, wherein the feeder 200 is fixed to extend across the pattern receiving surface 110, wherein a portion of the shield line 210 extending across the pattern receiving surface 110 is exposed, and wherein an end of the core line 210 is exposed; a ground pattern 500 having a plurality of ground-side dipole elements 520 connected to a ground-side transmission line 510 in the form of a stripe, wherein the plurality of the ground-side dipole elements 520 are attached to the pattern receiving surface 110, and wherein the ground-side transmission line 510 is attached to the exposed upper part of the shield line 210 to make an electrical connection therewith; an insulating element 400 in the form of a stripe, which is attached to an upper part of the ground-side transmission line 500; a signal pattern 300 having a plurality of signal-side dipole elements 320 connected to a signal-side transmission line 310 in the form of a stripe, wherein the plurality of the signal-side dipole elements 320 are attached to the pattern receiving surface 110, and wherein the signal-side transmission line 310 is attached to an upper part of the insulating element 400 while the signal-side transmission line 310 is electrically connected to the exposed end of the core line 230.

In accordance with another aspect of the present invention, there is provided a log periodic antenna, wherein the end of the core line 230 is connected with the signal-side transmission line 310 by soldering.

In accordance with another aspect of the present invention, there is provided a log periodic antenna wherein the feeder 200 is received in a long-recess 120 which is formed on the pattern receiving surface 110.

In accordance with another aspect of the present invention, there is provided a manufacturing method of a log periodic antenna comprising: a ground pattern 500 having a plurality of ground-side dipole elements 520 connected to a ground-side transmission line 510 in the form of a stripe; a signal pattern 300 having a plurality of signal-side dipole elements 320 connected to a signal-side transmission line 310 in the form of a stripe; and a pattern receiving surface 110 having the ground pattern and the signal attached thereto, the manufacturing method comprising steps of: preparing a feeder 200 having a core line 230 and a shield line 210, which respectively corresponds to a center conductor and an outer conductor and which are coaxially arranged, wherein the shield line 210 extending across the pattern receiving surface 110 is exposed, and wherein the core line 230 is exposed at one end thereof (S10); fixing the feeder 200 to extend across the pattern receiving surface 110 (S20); attaching the ground pattern 500 to the pattern receiving surface 110 to make the ground-side transmission line 510 attached to the exposed upper part of the shield line 210 (S30); attaching an insulating element 400 to an upper part of the ground-side transmission line 510 (S40); attaching the signal pattern 300 to the pattern receiving surface 110 to make the signal-side transmission line 310 attached to the upper part of the insulating element 400 (S50); and electrically connecting the signal-side transmission line 310 with the end of the core line 230 (S60).

The present invention including the above-described features enables the antenna to have the simple structure. Also, the present invention enables the antenna to cover the various designs of the log periodic antenna, because the signal pattern 300 and the grounds pattern 500 are fixed to the pattern receiving surface 110 by attachment and because the signal pattern 300 and the ground pattern 500 are readily modified even when it is desired to change the configuration of the antenna.

Further, the present invention makes the manufacturing process simple by connecting the ground pattern 500 and the shield line 210 without any soldering work and by connecting the signal pattern 300 and the core line 230 only with once-soldering, to thereby minimize the contacting points between the antenna elements and the feeder.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
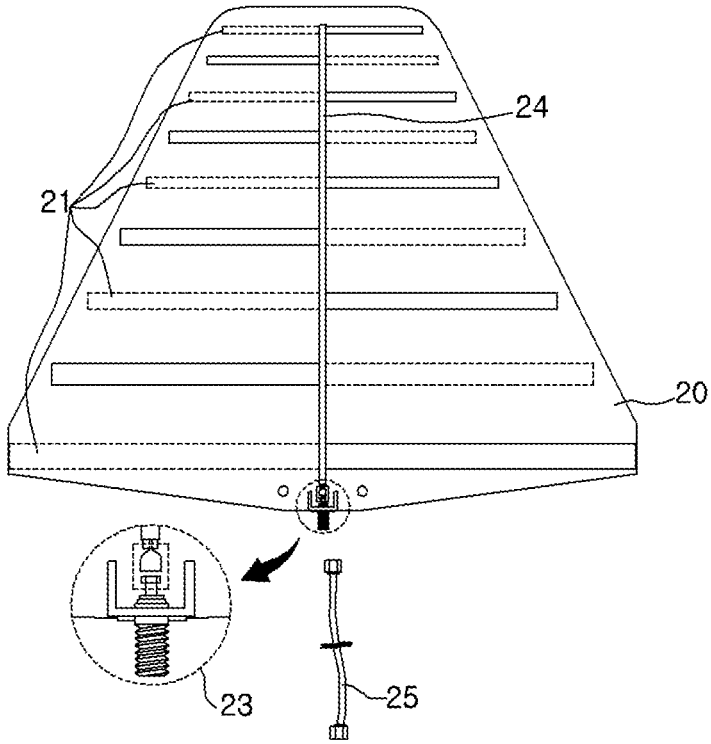
FIG. 1 is the bottom view of the log periodic antenna according to the prior art.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
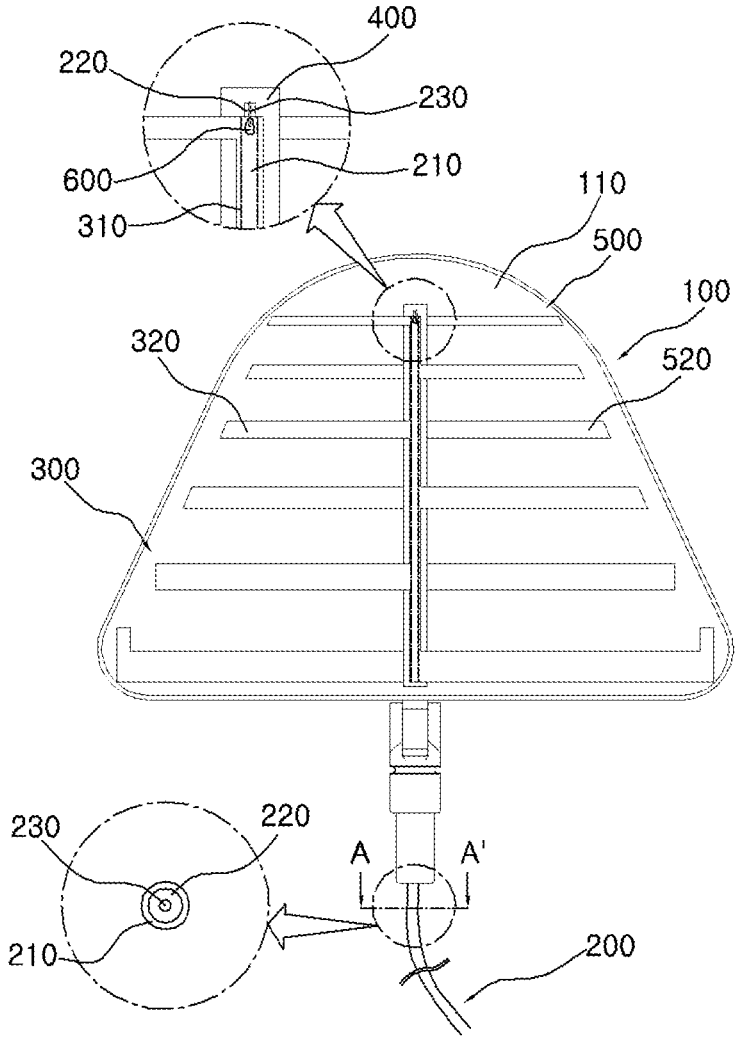
FIG. 2 is a plan view and an enlarged view of the log periodic antenna according to an embodiment of the present invention.
Figure 3:
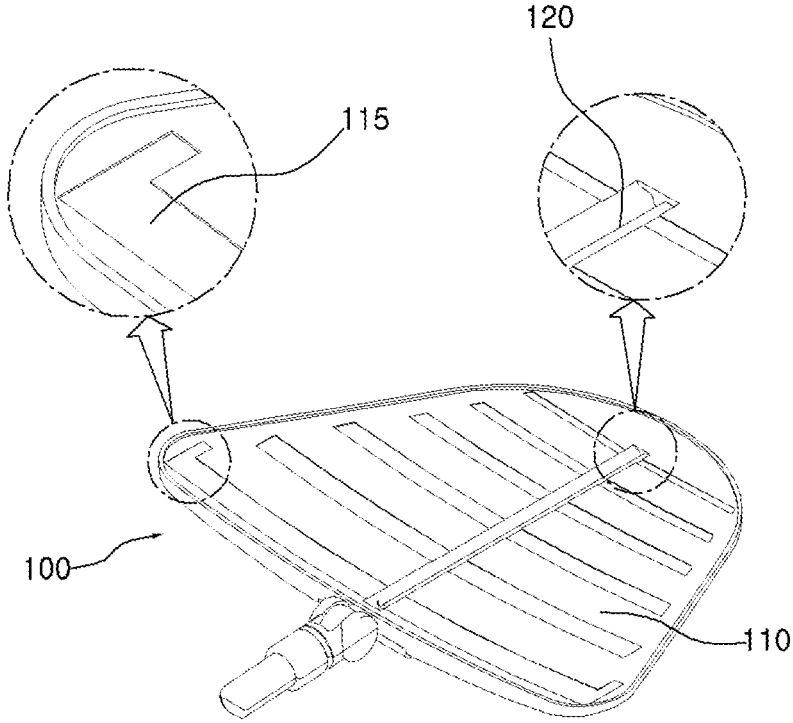
FIG. 3 is a perspective view and an enlarged view of the log periodic antenna according to the embodiment of the present invention.
Figure 4:
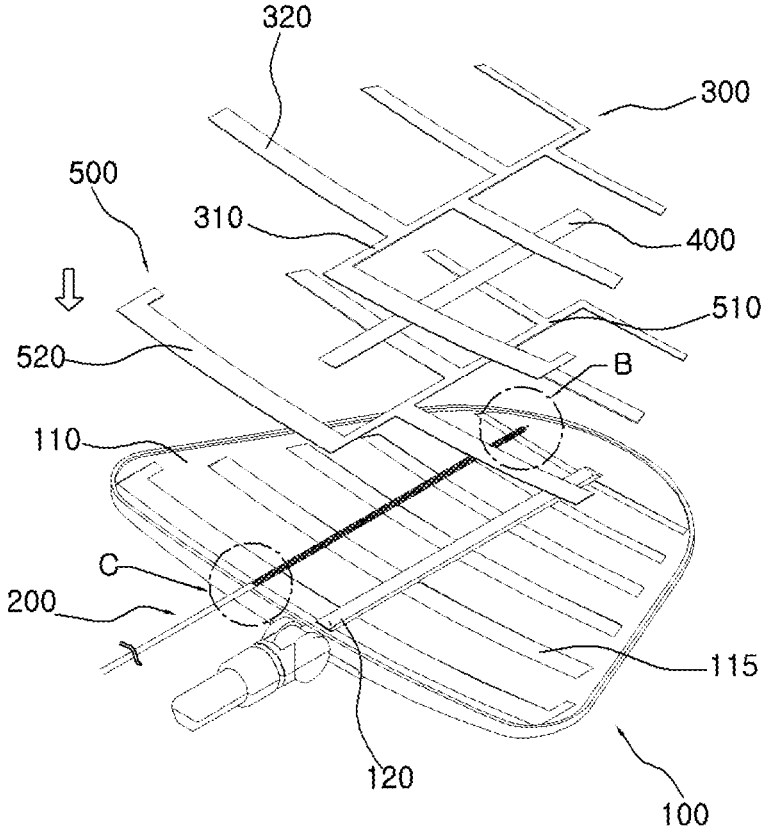
FIG. 4 is a perspective view illustrating a process of assembling the log periodic antenna according to the embodiment of the present invention.
Figure 5:
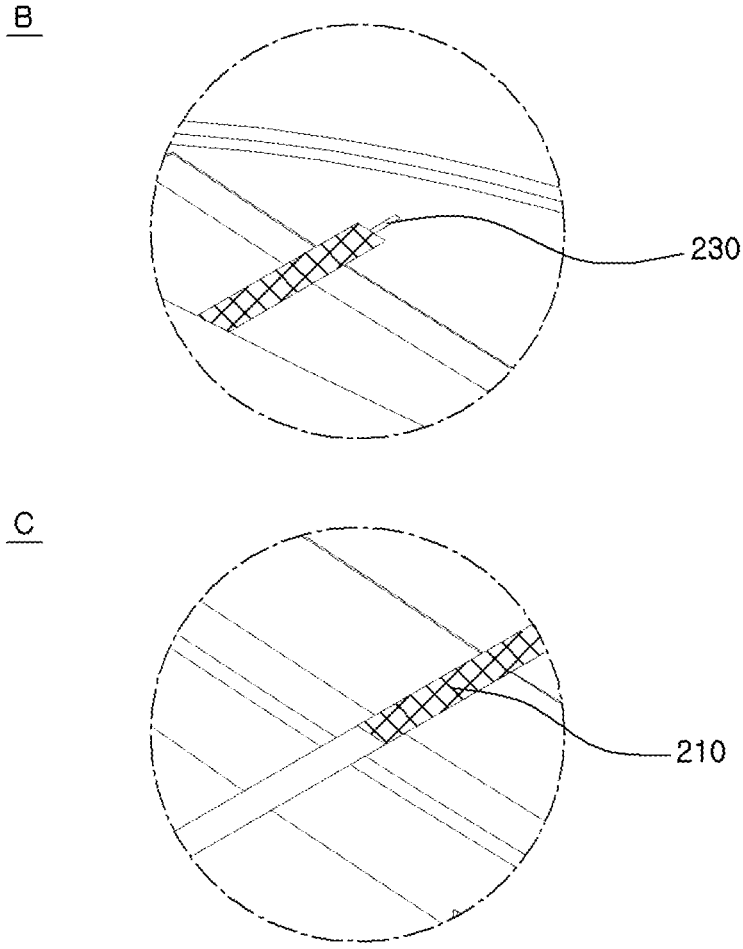
FIG. 5 is enlarged views illustrating circles indicated with "B" and "C" in FIG. 4.

FIG. 1 is the bottom view of the log periodic antenna according to the prior art. FIG. 2 is the plan view and the enlarged view of the log periodic antenna according to an embodiment of the present invention. FIG. 3 is the perspective view and the enlarged view of the log periodic antenna according to the embodiment of the present invention. FIG. 4 is the perspective view illustrating a process of assembling the log periodic antenna according to the embodiment of the present invention. FIG. 5 is the enlarged views illustrating circles indicated with "B" and "C" in FIG. 4.

Referring to FIGS. 2 to 5, the log periodic antenna according to the embodiment of the present invention comprise: an antenna main body 100 including a pattern receiving surface 110; a feeder 200 for transmitting signal; a signal pattern 300 and a ground pattern 500 connected to said feeder 200; and an insulating element 400 provided over the feeder 200 connected to said signal pattern 300 and to said ground pattern 500.

Also, the log periodic antenna of the present invention comprises: a long-recess 120, which is formed to extend across the middle of the pattern receiving surface 110; and pattern receiving recesses 115 formed on the pattern receiving surface 110.

The pattern receiving surface 110 is a plane surface provided on the antenna main body 100 and serves to have the feeder 200 fixed thereto and to receive the signal pattern 300 and the ground pattern 500 as described herein below. Here, the antenna main body 100 may be manufactured to include various configurations on the condition that the pattern receiving surface 110 is formed to be a plane.

Also, there is formed a long-recess 120 extending across the middle of the pattern receiving surface 110. The long-recess 120 serves to receive the feeder 200 and the insulating element 400 as described herein below. The long-recess 120 includes a lower section matched with the feeder 200 and a higher section matched with the insulating element 400.

Here, the width and the depth of the long-recess 120 may vary depending on the diameter of the feeder 200 and the thickness and the width of the insulating element 400.

On the surface of the pattern receiving surface 110, there are provided pattern receiving recesses 115, each of which has a shape matched with the signal pattern 300 or the ground pattern 500. Here, it is preferred that the pattern receiving recess 115 has such a depth as to correspond to the overlapping thicknesses of the signal pattern 300, the ground pattern 500 and the insulating element 400.

Thereby, even when the pattern receiving recess 115 receives the signal pattern 300, the ground pattern 500 and the insulating element 400, the pattern receiving surface 110 may maintain its flatness. Accordingly, the antenna main body 100 may keep the exterior configuration nicely.

The feeder 200 may be a coaxial cable, which is conventionally used for transmitting antenna signals. In the embodiment of the present invention, FBI-5C or HFBT-5C cable is used. However, a type of the cable is not restricted to these cables and other types of the coaxial cable suitable for transmitting the antenna signal may be used.

The conventional coaxial cable comprises a shield line 210 disposed at an outside, a core line 230 disposed at an inside and an insulator 220 disposed between the shield line 210 and the core line 230. In the present invention, the shield line 210 is connected to the ground pattern 500 to transmit a ground signal and the core line 230 is connected to the signal pattern 300 to transmit the antenna signal as described herein below.

One end of the feeder 200 is connected to the signal pattern 300 and to the ground pattern 500 as described herein below, while the other end of the feeder 200 is connected to an input terminal of the equipment, to which the signals detected on the signal pattern 300 and on the ground pattern 500 are transmitted.

The feeder 200 extends across the pattern receiving surface 110 and is located in the middle of the receiving surface 110. Specifically, the feeder 200 is positioned at the middle of the width. The feeder 200 is received in the long-recess 120 formed along the length of the pattern receiving surface 110 so as to be fixed therein.

Here, the feeder 200 is fixed in the long recess 200 in a state that an outer coat of the feeder 200 is removed to expose the shield line 210. The length of the outer coat removed from the feeder 200 corresponds to the length extending across the antenna main body 100. Also, the core line 210 is exposed only at the end of the feeder 200 by removing the shield line 210 and the insulator 220.

The ground pattern 500 has such a form as to make a plurality of ground-side dipole elements 520 connected to a ground-side transmission line 510 in the form of a stripe. In other words, the plurality of the ground-side dipole elements 520, the lengths of which are different to each other, extend from the ground-side transmission line 510 with a constant interval there-between. Also, the ground-side dipole elements 520 have a dipole arrangement in which the lengths of the dipole elements increase or decrease in a uniform manner.

The plurality of the ground-side dipole elements 520 are received in the pattern receiving recesses 115 formed on the pattern receiving surface 110. The ground-side transmission line 510 is attached to the upper part of the exposed shield line 210 of the feeder 200. As a result, the shield line 210 and the ground-side transmission line 510 are electrically connected to each other.

The insulating element 400 in the form of a stripe is fixed to the upper part of the ground-side transmission line 510. In other words, the insulating element 400 is disposed between the ground-side transmission line 510 and a signal-side transmission line 310 of the signal pattern 300 to prevent the ground pattern 500 from being electrically connected to the signal pattern 300.

Here, the shape of the insulating element 400 is made to match with that of the ground-side transmission line 510, but it is preferable that the width and the length of the insulating element 400 is larger than those of the ground-side transmission line 510. It is for the purpose of completely preventing the ground-side transmission line from being electrically connected to the signal pattern 300 as described below.

Further, the insulating element 400 is received in the long-recess 120 formed on the pattern receiving surface 110. Preferably, the insulating element 400 is made to be thin in order to avoid an excessive thickness when the signal pattern 300 overlaps the ground pattern 500.

The signal pattern 300 has such a form as to make the plurality of the signal-side dipole elements 320 connected to the signal-side transmission line 310 in the form of the stripe. In other words, the signal-side dipole elements 320, the lengths of which are different to each other, extend from the signal-side transmission line 310 with the constant interval there-between. Also, the signal-side dipole elements 320 have a dipole arrangement in which the lengths of the elements increase or decrease in a uniform manner.

The plurality of the signal-side dipole elements 320 are fixed in the pattern receiving recesses 115 and the signal-side transmission line 310 is attached to the upper surface of the insulating element 400.

Here, the signal-side transmission line 310 is electrically connected to the core line 230 exposed at the end of the feeder 200. Specifically, the core line 230 exposed at the end of the feeder 200 is bent toward the signal-side transmission line 310 to make the contact there-between to thereby attain electrical connection.

Here, the signal-side transmission line 310 and the core line 230 are connected to each other by means of soldering.

The ground-side dipole element 520 and the signal-side dipole element 320 are disposed one by one at either side of the feeder 200. Specifically, if the signal-side dipole element 320 is disposed at a left side of the feeder 200, the ground-side dipole element 520 is disposed at a right side of the feeder 200.

The signal-side dipole elements 320 of the signal pattern 300 and the ground-side dipole elements 520 of the ground pattern 500, which have the smaller lengths, cover the lower frequency band (for instance, band of 450 MHz), whereas the signal-side dipole elements 320 and the ground-side dipole elements 520, which have the longer length, cover the higher frequency band (for instance, band of 870 MHz).

In contrast to the prior art, the antenna according to the present invention has the simple structure. Further, the present invention enables the antenna to cover the various designs of the log periodic antenna without any restriction to the shape of the antenna body 100, because the signal pattern 300 and the ground pattern 500 are fixed to the pattern receiving surface 110 by attachment and because the signal pattern 300 and the ground pattern 500 may be readily manufactured.

The manufacturing method of the log periodic antenna according to the present invention will be detailed herein below.

Figure 6:
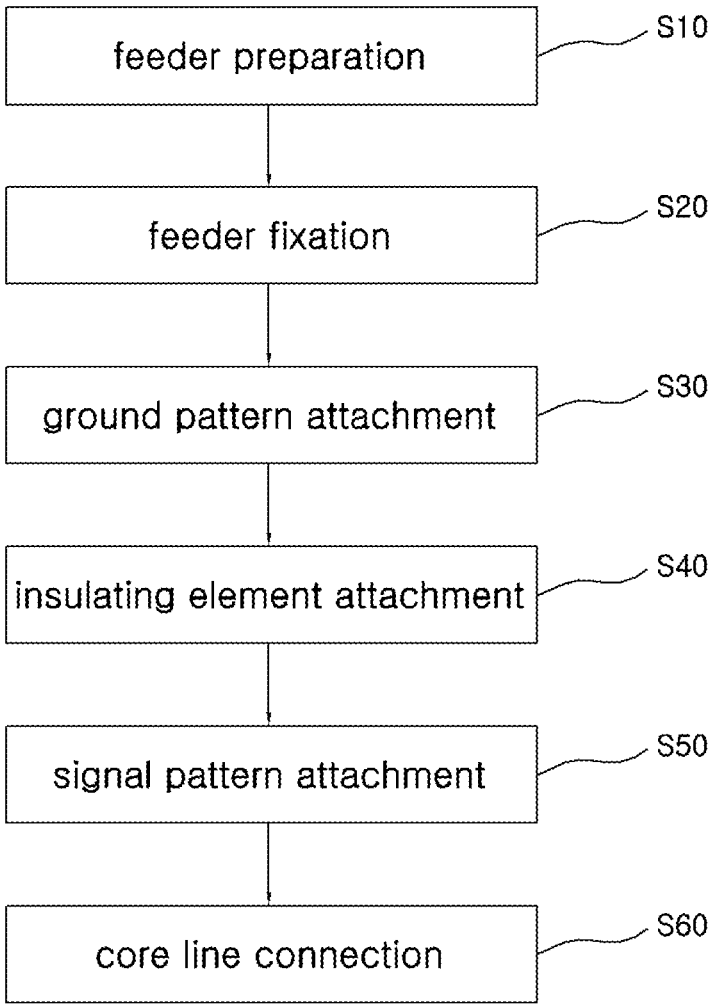
FIG. 6 is a flow chart illustrating the manufacturing method of the log periodic antenna according to the embodiment of the present invention.

FIG. 6 is the flow chart illustrating the manufacturing method of the log periodic antenna according to the embodiment of the present invention.

1. Step (1): Preparation of the Feeder (S10)

The coaxial cable, such as FBT-5C type or HFBT-5C type, is prepared and used as the feeder. Here, the feeder 200 is the coaxial cable comprising the shield line 210 disposed at the outside, the core line 230 disposed at the inside and the insulator 220 disposed between the shield line 210 and the core line 230.

The outer coat of the feeder 200 is peeled as much as the peeled length thereof extends across the pattern receiving surface 110, to thereby expose the shield line 210. At the end of the feeder 200, the shield line 210 and the insulator 220 are removed to thereby expose the core line 230 only. Here, it is preferred that the core line 230 does not contact to the shield line 210 by leaving a portion of the insulator 220 at the exposed portion of the core line 230. In other words, the insulator 220 is less removed than the shield line 210 by peeling the insulator 220 after removing the shield line 210.

2. Step 2: Fixation of the Feeder (S20)

The feeder 200 prepared in Step 1 is fixed to extend across the pattern receiving surface 110. Here, the feeder 200 is received in the long-recess 120 formed in the middle of the pattern receiving surface 110. Specifically, the feeder 200 is received in the long-slot 120 and fixed therein.

2. Step 3: Attachment of the Ground Pattern (S30)

In Step 3, the ground pattern 500 is attached to the pattern receiving surface 110. The ground pattern 500 has such a form as to have the plurality of the ground-side dipole elements 520 connected to the ground-side transmission line 510.

With the feeder 200 disposed in the long-slot 120 formed in the middle of the pattern receiving surface 110 in Step 2, the ground-side transmission line 510 is adjacently disposed over the exposed shield line 210 to thereby electrically connect the shield line 210 to the ground-side transmission line 510.

At the same time, the plurality of the ground-side dipole elements 520 are received in the pattern receiving recess 115 to be attached therein. Here, the bottom of the dipole element 520 is applied with adhesive, which is covered with a protective film (not shown). When removing the protective film and then putting the plurality of the ground-side dipole elements 520 into the pattern receiving recess 115, the adhesive makes the plurality of the ground-side dipole elements 520 attached to the pattern receiving recess 115.

As an alternative, in the process of fixing the plurality of the ground-side dipole elements 520, the adhesive is applied to the pattern receiving recess 115 beforehand, and then the plurality of the ground-side dipole elements 520 are attached by means of the adhesive in the pattern receiving recess 115. One of ordinary skill in the art may employ either one.

Here, since the feeder 200 is made to expose the shield line 210 to the outside, the ground-side transmission line 510 may be electrically connected to the shield line 210 only by contacting the former to the latter.

Accordingly, it is preferred that the underside of the ground-side transmission line 510 is not applied with the adhesive. Exceptionally, conductive adhesive may be used.

4. Step 4: Attachment of the Insulator

In Step 4, the insulating element 400 is attached to the upper part of the ground-side transmission line 510. Here, the insulating element 400 in the form of the stripe is attached only to the ground-side transmission line 510, but not to the plurality of the ground-side dipole elements 520.

Also, the way of attaching the insulating element 400 is the same as that of attaching the plurality of the ground-side dipole elements 520.

5. Step 5: Attachment of the Signal Pattern (S50)

In Step 5, the signal pattern 300 is attached to the pattern receiving surface 110, wherein the signal pattern 300 has such a form as to have the plurality of the signal-side dipole elements 320 connected to the signal-side transmission line 310 in the form of the stripe.

With the insulating element 400 attached to the around-side transmission line 510 in Step 4, the signal pattern 300 and the signal-side transmission line 310 are attached to the upper side of the insulating element 400.

At the same time, the plurality of the signal-side dipole elements 320 are received in the pattern receiving recess 115 formed on the pattern receiving surface 110 so as to be attached thereto.

Here, the signal-side transmission line 310 of the signal pattern 300 and the ground-side transmission line 510 of the ground pattern 500 overlap to each other, whereas the plurality of the signal-side dipole elements 320 are alternatively disposed with the plurality of the ground-side dipole elements 520. In other words, the insulating element 400 is disposed between the signal-side transmission line 310 and the ground-side transmission line 510, whereas the signal side dipole element 320 does not overlap the ground-side dipole elements 520, and thus they are not electrically connected to each other.

Also, the way of attaching the signal pattern 300 is the same as that of attaching the plurality of the ground-side dipole elements 520.

6. Step 6: Connection of the Core Line (S60)

In Step 6, the signal-side transmission line 310 is soldered to the core line 230 prepared in Step 1. The core line 230 is bent toward the signal-side transmission line 310 to make contact with the latter. Afterward, the contacting point between the signal-side transmission line 310 and the core line 230 is electrically connected by once-soldering.

Accordingly, in contrast to the prior art, the log periodic antenna of the present invention makes the manufacturing process simple by minimizing the contacting points between the antenna element and the feeder.

Further, the log periodic antenna manufactured by the method of the present invention is wrapped by a cover (not shown) or painted using various colors of pigments, so that it is applied for many uses, such as an outdoor or indoor antenna.

On the other hand, in the design theory of the general log periodic antenna, a design constant ($\tau$) for determining the length and the number of the antenna elements and a relative spacing ($\sigma$) for determining the distance between the antenna elements and the boom length are taken into consideration. The formula for calculating the design constant ($\tau$) and the relative spacing ($\sigma$) or the method of arranging the antenna elements using the formula is well known to one of ordinary skill in the art, and thus the detailed description thereof is not provided herein.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A log periodic antenna having a pattern receiving surface for receiving a signal pattern and a ground pattern, the log periodic antenna comprising:

a feeder having a core line wrapped by an insulator and a shield line shielding the feeder, wherein the feeder is fixed to extend across the pattern receiving surface, wherein a portion of the shield line extending across the pattern receiving surface is exposed, and wherein an end of the core line is exposed;

a ground pattern having a plurality of ground-side dipole elements connected to a ground-side transmission line in the form of a stripe, wherein the plurality of the ground-side dipole elements are attached to the pattern receiving surface, and wherein the ground-side transmission line is attached to the exposed upper part of the shield line to make an electrical connection therewith;

an insulating element in the form of a stripe, which is attached to an upper part of the ground-side transmission line;

a signal pattern having a plurality of signal-side dipole elements connected to a signal-side transmission line in the form of a stripe, wherein the plurality of the signal-side dipole elements are attached to the pattern receiving surface, and wherein the signal-side transmission line is attached to an upper part of the insulating element while the signal-side transmission line is electrically connected to the exposed end of the core line.

2. The log periodic antenna as claimed in claim 1, wherein the end of the core line is connected with the signal-side transmission line by soldering.

3. The log periodic antenna as claimed in claim 2, wherein the feeder is received in a long-recess which is formed on the pattern receiving surface.

4. A method of manufacturing a log periodic antenna, which includes a ground pattern having a plurality of ground-side dipole elements connected to a ground-side transmission line in the form of a stripe, a signal pattern having a plurality of signal-side dipole elements connected to a signal-side transmission line in the form of a stripe, and a pattern receiving surface having the ground pattern and the signal attached thereto, the method comprising the steps of:

(S10) preparing a feeder having a core line and a shield line, which respectively correspond to a center conductor and an outer conductor and which are coaxially arranged, wherein the shield line extending across the pattern receiving surface is exposed, and wherein the core line is exposed at one end thereof;

(S20) fixing the feeder to extend across the pattern receiving surface;

(S30) attaching the ground pattern to the pattern receiving surface to make the ground-side transmission line attached to the exposed upper part of the shield line;

(S40) attaching an insulating element to an upper part of the ground-side transmission line;

(S50) attaching the signal pattern to the pattern receiving surface to make the signal-side transmission line attached to the upper part of the insulating element; and (S60) electrically connecting the signal-side transmission line with the end of the core line.

* * * * *